US010206839B2

(12) United States Patent
Wakabayashi et al.

(10) Patent No.: US 10,206,839 B2
(45) Date of Patent: Feb. 19, 2019

(54) INCUBATOR

(71) Applicant: ATOM MEDICAL CORPORATION, Bunkyo-ku, Tokyo (JP)

(72) Inventors: Keisuke Wakabayashi, Saitama (JP); Masato Honda, Saitama (JP); Yutaka Sekiguchi, Saitama (JP); Ichiro Matsubara, Tokyo (JP); Terumi Matsubara, Tokyo (JP)

(73) Assignee: ATOM MEDICAL CORPORATION, Bunkyo-Ku, Tokyo (JP)

( * ) Notice: Subject to any disclaimer, the term of this patent is extended or adjusted under 35 U.S.C. 154(b) by 162 days.

(21) Appl. No.: 15/341,723

(22) Filed: Nov. 2, 2016

(65) Prior Publication Data

US 2017/0128302 A1 May 11, 2017

(30) Foreign Application Priority Data

Nov. 9, 2015 (JP) ..... 2015-219427

(51) Int. Cl.
*A61G 11/00* (2006.01)

(52) U.S. Cl.
CPC ..... *A61G 11/006* (2013.01)

(58) Field of Classification Search
CPC ..... A61G 11/00; A61G 11/005
USPC ..... 600/21–22
See application file for complete search history.

(56) References Cited

U.S. PATENT DOCUMENTS

2012/0269568 A1* 10/2012 Matsubara ..... A61G 11/006 403/104
2013/0185867 A1* 7/2013 Long ..... A47D 7/04 5/95
2016/0158085 A1 6/2016 Matsubara et al.

FOREIGN PATENT DOCUMENTS

EP 3 053 567 A1 8/2016
JP H11-299841 A 11/1999
JP 2012-223320 A 11/2012
JP 2014-33769 A 2/2014

OTHER PUBLICATIONS

Extended Search Report in corresponding European Application No. 16195763.4, dated Mar. 14, 2017, 6 pages.
Office Action, and English language translation thereof, in corresponding Japanese Application No. 2015-219427, dated Dec. 13, 2016, 8 pages.

* cited by examiner

*Primary Examiner* — John Lacyk
(74) *Attorney, Agent, or Firm* — Brinks, Gilson & Lione

(57) ABSTRACT

The present invention provides an incubator in which there is no concern of a user feeling pain or injuring their arm, even if their arm makes comparatively hard contact with an upper end of baby guards when the user has placed their arm inside an infant accommodation space. The baby guards are formed with a protrusion and have sufficient strength as a guard configuration body at an outer periphery of the infant accommodation space, and the width of a region inside the baby guards where observation by the user is slightly inconvenienced does not become particularly large. In the incubator, at least one of the baby guards includes the substantially rod shaped protrusion configuring an upper end of the at least one baby guard when in a substantially upright state that is substantially upward.

12 Claims, 10 Drawing Sheets

INCUBATOR

RELATED APPLICATIONS

This application claims priority under 35 U.S.C. § 119 to Japanese Patent Application No. 2015-219427 filed on Nov. 9, 2015, the entire content of which is hereby incorporated by reference.

BACKGROUND OF THE INVENTION

Technical Field

The present invention relates to an incubator including baby guards for forming an outer periphery of an infant accommodation space.

Related Art

Incubators configured as described above are already known, such as that described in Japanese Patent Application Laid-Open (JP-A) No. 2012-223320 (referred to below as "Patent Document 1"). In the incubator described in Patent Document 1 (referred to below as "the incubator of Patent Document 1"), a flat container shaped mattress tray is installed on an incubator base. The incubator base is respectively installed with the following so as to form a substantially rectangular shape overall in plan view: a fixed wall section that generally configures a wall section on the head side of an infant (a so-called fixed baby guard); a leg side movable wall section that generally configures a wall section on the leg side of the infant (a so-called movable baby guard); a left side movable wall section that generally configures a wall section on the left side of the infant (a so-called movable baby guard); and a right side movable wall section that generally configures a wall section on the right side of the infant (a so-called movable baby guard). A substantially cuboid shaped infant accommodation space open on the upper face is configured by the mattress tray (in other words, by a mattress on the mattress tray) and by the single fixed wall section and the three movable wall sections which may each be substantially rectangular shaped and may be substantially transparent. The three movable wall sections and the single fixed wall section are each configured overall from a substantially transparent plastic sheet. The three movable wall sections are each configured so as to be capable of swinging to-and-fro between an upstanding state substantially upward (referred to below as "the upstanding state") and a hanging state substantially downward (referred to below as "the hanging state"), by swinging about swing support shafts that are installed on the left and right sides, or the front and rear sides, in the vicinity of the lower edges in the upstanding state.

However, in the incubator of Patent Document 1, the respective plate thicknesses of the three movable wall sections and the single fixed wall section for configuring an open incubator are each approximately 5 mm. When a user lays an infant such as a newborn baby on the mattress of the open incubator, or picks up the infant from the mattress, the user places their arm in the infant accommodation space. There is a possibility that the arm of the user might contact an upper end of at least one wall section out of the three movable wall sections and the single fixed wall section in such cases. If the arm of the user makes hard contact with the upper end of the movable wall sections or the fixed wall section, there is a possibility that the user might feel pain, or injure their atm.

SUMMARY OF THE INVENTION

The present invention effectively resolves the above-described issue relating to the incubator of Patent Document 1 using a comparatively simple configuration.

The present invention relates to an incubator including baby guards for fondling an outer periphery of an infant accommodation space, wherein at least one of the baby guards includes a substantially rod shaped protrusion configuring an upper end of the at least one baby guard when in a substantially upright state that is substantially upward. In the above configuration, the upper end of the at least one baby guard includes the substantially rod shaped protrusion, thereby enabling a first advantageous effect to be exhibited in which, even if the arm of a user makes comparatively hard contact with the upper end of the baby guard when the user places their arm in the infant accommodation space to lay an infant such as a newborn baby onto a mattress or the like in the incubator, or to lift the infant up from the mattress, there is substantially no concern of the user feeling pain or injuring their arm. Moreover, since the upper end of the at least one baby guard includes the substantially rod shaped protrusion, a second advantageous effect can be exhibited in which the baby guard formed with the protrusion has sufficient strength as a guard configuration body as the outer periphery of the infant accommodation space. Furthermore, since the upper end of the at least one baby guard is substantially rod shaped, a third advantageous effect can be exhibited in which the width of a region inside the baby guards through which a user or the like observes through the substantially rod shaped upper end of the baby guard is not particularly large, such that there is almost no possibility of even a slight inconvenience to the observation when the user or the like observes the inside of the baby guards from close to the outer periphery of the incubator.

In a first aspect of the present invention, at least an upper face of the protrusion is a substantially continuous curved face having substantially no corners when in the substantially upstanding state in which the at least one baby guard is substantially upward. In a second aspect of the present invention, a ratio of a thickness of an intermediate portion of a wall section body of the at least one baby guard with respect to a horizontal direction width of the protrusion is within a range from 0.45 to 0.9 (more preferably within a range from 0.5 to 0.85, and most preferably within a range from 0.55 to 0.8), and a ratio of the thickness of the intermediate portion of the wall section body with respect to a vertical direction length of the protrusion is within a range from 0.45 to 0.9 (more preferably within a range from 0.5 to 0.85, and most preferably within a range from 0.55 to 0.8). In a first mode of the second aspect of the present invention, a cross-section of the protrusion in a direction substantially orthogonal to a length direction of the protrusion has a substantially circular shape. In a second mode of the second aspect of the present invention, a cross-section of the protrusion in a direction substantially orthogonal to a length direction of the protrusion has a substantially polygonal shape having a number of sides of a quadrangular shape or greater and having rounded corners.

In a third aspect of the present invention, a ratio of a thickness of an intermediate portion of a wall section body of the at least one baby guard with respect to a horizontal direction width of the protrusion is within a range from 0.45 to 0.9 (more preferably within a range from 0.5 to 0.85, and most preferably within a range from 0.55 to 0.8), and a ratio of the thickness of the intermediate portion of the wall section body with respect to a vertical direction length of the protrusion is within a range from 0.67 to 1.33 (more preferably within a range from 0.75 to 1.25, and most preferably within a range from 0.8 to 1.2). In a first mode of the third aspect of the present invention, a cross-section of the protrusion in a direction substantially orthogonal to a length direction of the protrusion has a substantially elliptical shape or a substantially oval shape that is elongated along a substantially horizontal direction.

The above-described first advantageous effect, second advantageous effect, and third advantageous effect can be still more reliably exhibited in the above-described first aspect, second aspect, first and second modes of the second aspect, as well as the third aspect of the present invention. Moreover, the above-described second aspect and third aspect of the present invention enable an attachment-attaching tool has been generally employed hitherto to be used in order to attach an attachment to the incubator, without having to prepare an attachment-attaching tool with a special shape or structure.

The above-described and other objects, characteristics, advantages of the present invention should become clear from reading the following detailed description, relating to the attached drawings.

BRIEF DESCRIPTION OF THE DRAWINGS

Exemplary embodiments of the present invention will be described in detail based on the following figures, wherein.

DETAILED DESCRIPTION OF THE INVENTION

Next, explanation follows regarding an exemplary embodiment of the present invention as applied to an open incubator (a so-called infant warmer), modified examples 1 and 2, and reference examples 1 and 2, with reference to the drawings, under the headings "1. Brief Explanation of Overall Incubator", "2. Explanation of Inner Wall Section Structure", "3. Explanation of Configuration of Outer Wall Structure", and "4. Explanation of Operation of Outer Wall Section Structure".

12. Brief Explanation of Overall Incubator

Figure 1:
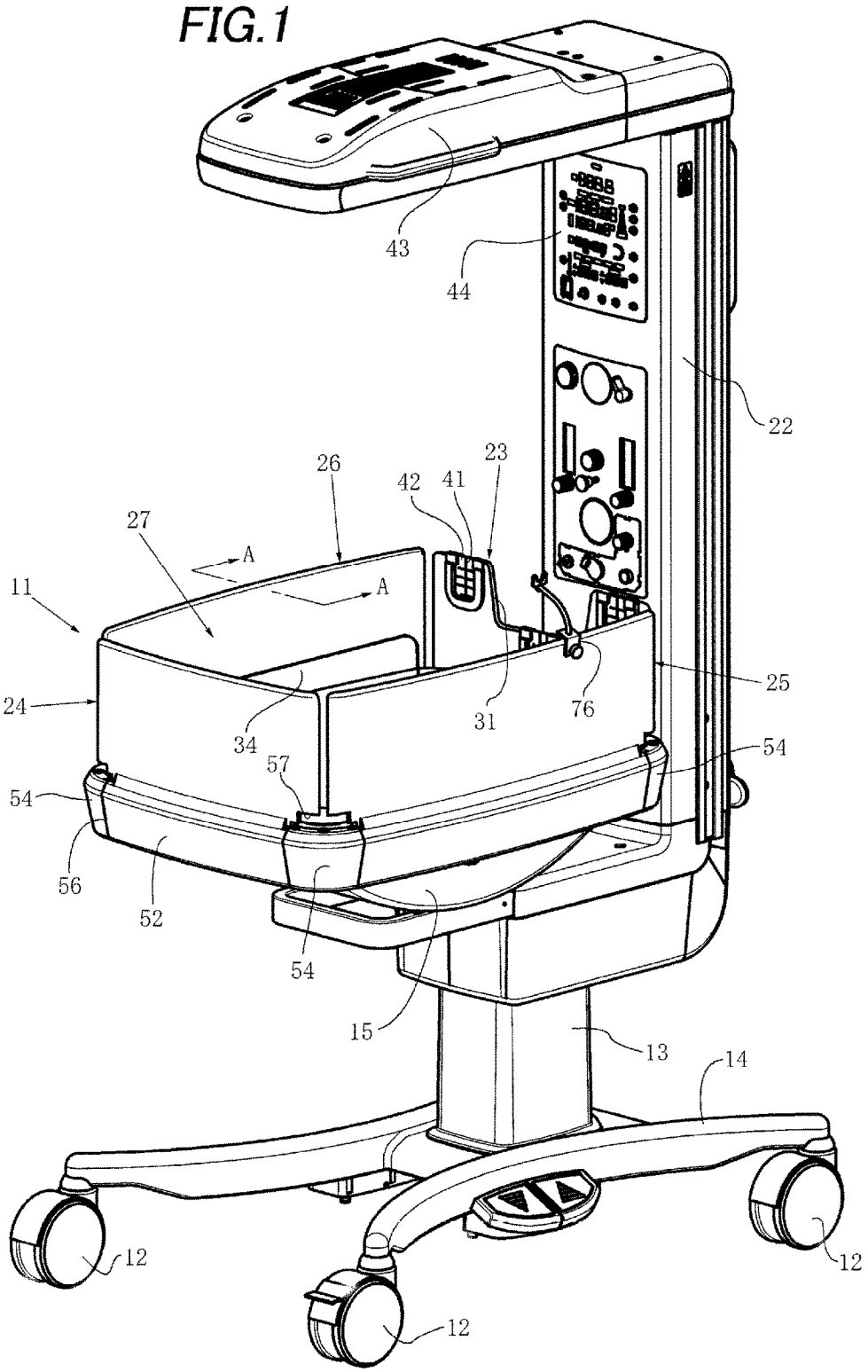
FIG. 1 is a perspective view of an open incubator of an exemplary embodiment of the present invention, in a normal use state.
Figure 2:
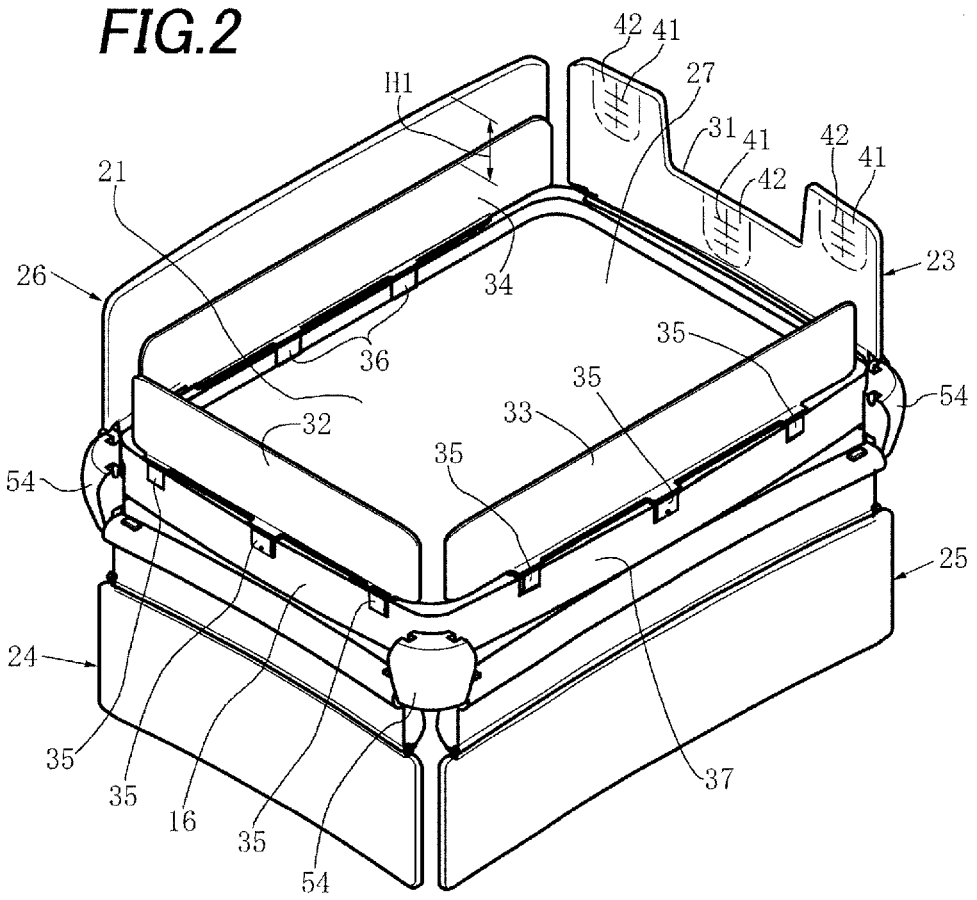
FIG. 2 is a perspective view of the open incubator illustrated in FIG. 1, in a state in which two outer wall sections are open.

An open incubator 11, as illustrated in FIG. 1, includes a trolley 14, to which wheels 12 and a main pillar 13 are respectively attached. More specifically, the wheels 12 are attached below four corners of the trolley 14, and the main pillar 13 is attached above the trolley 14. An incubator base 15 is then installed above the main pillar 13. A flat container shaped mattress tray 16 is installed, as illustrated in FIG. 1 and FIG. 2, onto the incubator base 15. Moreover, a mattress 21 can be laid on the mattress tray 16 to enable an infant, such as a newborn baby, to be laid thereon.

The mattress tray 16 that has been installed by being attached and fixed onto the incubator base 15 is respectively installed with the following, as illustrated in FIG. 1 and FIG. 2, so as to form a substantially rectangular shape overall in plan view: an outer wall section (a so-called outer baby guard) 23 generally configuring an outer wall section on the head side of an infant, adjacent to an ancillary equipment support column 22 installed to the main pillar 13; an outer wall section (a so-called outer baby guard) 24 generally configuring an outer wall section on the leg side of an infant; an outer wall section (a so-called outer baby guard) 25 generally configuring an outer wall section on the left side of an infant; and an outer wall section (a so-called outer baby guard) 26 generally configuring an outer wall section on the right side of an infant. A substantially cuboid shaped infant accommodation space 27 open on the upper face is configured by the mattress tray 16 (in other words, the mattress 21) and the outer wall sections 23 to 26 that may each be substantially rectangular shaped, and may be substantially transparent. Note that the left side outer wall section 25 and the right side outer wall section 26 may have substantially the same dimensions as each other. The outer wall section 23 and the outer wall section 24, which have lengths in their respective length directions (in other words, horizontal directions) that are slightly shorter than those of the outer wall sections 25, 26, may have substantially the same dimensions as each other, except for cutout shaped indentation 31 that is provided in the outer wall section 23 so as to extend from a substantially central portion of an upper edge of the outer wall section 23 to partway toward the lower edge thereof. The outer wall sections 23 to 26 may be respectively configured from sheets of plastic, such as acrylic resin, which are substantially transparent overall. Each of the outer wall sections 24 to 26 is configured so as to be capable of swinging to-and-fro between a substantially upstanding state that is substantially upward (referred to below as "the upstanding state") as illustrated in FIG. 1, and a hanging state that is substantially downward (referred to below as "the hanging state"; however, in FIG. 2, the outer wall section 26 is illustrated in the upstanding state) as illustrated in FIG. 2, by swinging about swing support shafts (not illustrated in the drawings) arranged on the left and right sides, or the front and rear sides, in the vicinity of the lower edges in the upstanding state illustrated in FIG. 1.

At the outer periphery of the mattress tray 16, as illustrated in FIG. 2, inner wall sections 32, 33, 34 are respectively arranged along the outer periphery of the mattress tray 16 so as to form a substantially U-shape overall in plan view. The inner wall sections 32 to 34 may each be configured from sheets of plastic, such as acrylic resin, which are substantially transparent overall. The leg side inner wall section 32 may be attached to the mattress tray 16 so as to project substantially upward in the vicinity of a leg side end portion of the mattress tray 16, so as to be detachable therefrom (in other words, detachably attached). The inner wall sections 33, 34 on the left side and the right side may be respectively attached to the mattress tray 16 so as to project substantially upward from the respective end portions on the left side and the right side of the mattress tray 16, so as to be detachable therefrom (in other words, detachably attached).

As illustrated in FIG. 1 and FIG. 2, an appropriate number (three in this exemplary embodiment) of grommet members 42 having notches 41 for holding cables may be respectively attached to a portion of the cutout shaped indentation 31 of the outer wall section 23 and to portions on the left and right of this portion. Elongated shaped members (not illustrated in the drawings) such as oxygen supply tubes may be held in the notches 41 in a state in which they pass through the grommet members 42. An infrared heater 43 is installed at the upper end of the ancillary equipment support column 22. Moreover, various measuring and/or control devices 44 for body temperature, $SpO_2$, and the like are installed to the ancillary equipment support column 22 so as to be substantially positioned between the infrared heater 43 and the infant accommodation space 27 as viewed from the front. Specifically, configuration may be made such that a body temperature controller from out of the measuring and/or control devices 44 is input with a signal from a body temperature probe that measures the body temperature of the infant and displays the body temperature, so as to be able to control the heating temperature and the like of the infrared heater 43.

2. Explanation of Inner Wall Section Structure

The leg side inner wall section 32 may, as illustrated in FIG. 2, extend at the vicinity of the leg side end of the mattress tray 16 for substantially the entire length thereof. The left side inner wall section 33 may extend at the vicinity of the left side end of the mattress tray 16 for substantially the entire length thereof. The right side inner wall section 34 may extend at the vicinity of the right side end of the mattress tray 16 for substantially the entire length thereof. Moreover, due to the left and right ends of the inner wall section 32 being respectively separated from the front ends of the inner wall sections 33, 34, the inner wall sections 32 to 34 are each respectively configured as a separate component. However, the left and right ends of the inner wall section 32 may be coupled to the front ends of the inner wall sections 33, 34. In such cases, the inner wall sections 32 to 34 may be configured as a single frame body of substantially U-shape overall. The inner wall sections 32 to 34 may be respectively equipped with attachment protrusions 35 that may each have a substantially L-shape projecting downward.

Specifically, as illustrated in FIG. 2, three, for example, of the attachment protrusions 35 are arranged on each of the inner wall sections 32 to 34, such as by integral molding, so as to project downward from outer faces thereof. Two, for example, attachment protrusions 36 are arranged on each of the inner wall sections 32 to 34, such as by integral molding, so as to project downward from inner faces thereof. When the inner wall sections 32 to 34 are attached to side walls 37 of the mattress tray 16, the attachment protrusions 35 and the attachment protrusions 36 of the inner wall sections 32 to 34 respectively abut the outer faces and the inner faces of the side walls 37 of the mattress tray 16. Thus, the side walls 37 are respectively interposed between the attachment protrusions 35 and the attachment protrusions 36 that are present on both sides thereof, such that the inner wall sections 32 to 34 are respectively attached and fixed to the side walls 37 of the mattress tray 16 so as to be detachable therefrom (in other words, detachably attached).

3. Explanation of Configuration of Outer Wall Structure

Figure 3:
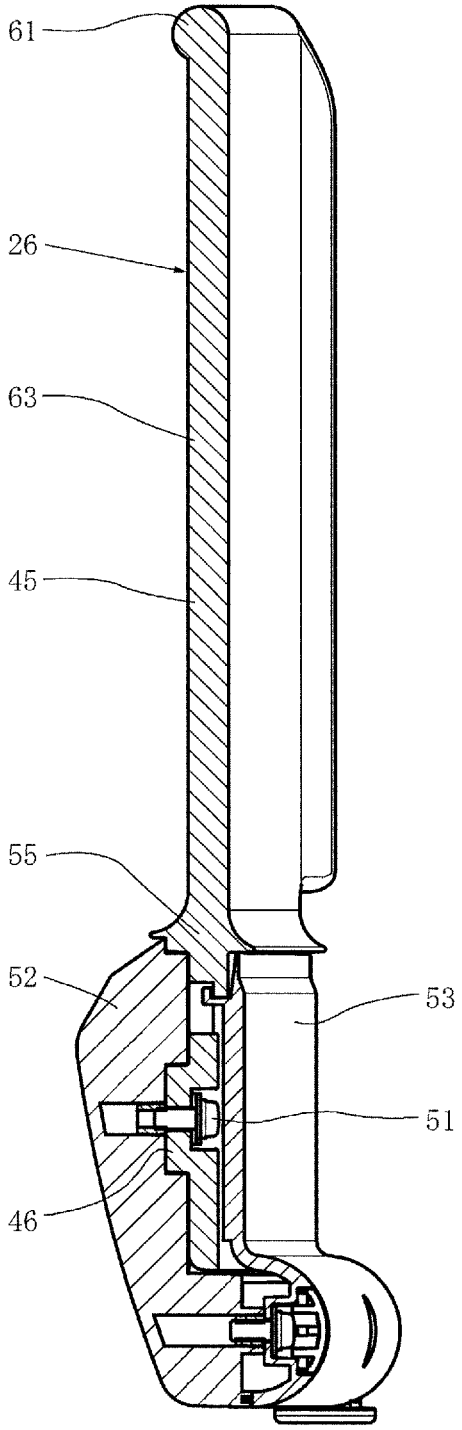
FIG. 3 is a partial vertical cross-section along line A-A in FIG. 1.

As illustrated in FIG. 1 to FIG. 3, the outer wall sections 23 to 26 each include a wall section body 45, and a support member 52 that is screw-fixed by screws 51 to a substantially lower end 46 of the respective wall section body 45. Substantially the entire inner face of the substantially lower end 46 of the respective wall section body 45 is covered by a cover member 53. As illustrated in FIG. 1 and FIG. 2, at the vicinity of the two ends on the left and right, or front and rear, sides of the lower ends of the respective support members 52 of the outer wall sections 23 to 26, the outer wall sections 23 to 26 are attached to respective attachment members 54 by a pair of swing support shafts (not illustrated in the drawings) so as to be capable of swinging. The attachment members 54 are respectively attached so as to be fixed to substantially the four corners of the mattress tray 16. A pair of coupling members (not illustrated in the drawings) are respectively engaged with engaged portions (not illustrated in the drawings) of the attachment members 54 that are arranged on either side in substantially the horizontal direction of the respective outer wall sections 23 to 26, so as to be detachable therefrom. Note that, as illustrated in FIG. 1 and FIG. 3, etc., a portion of each wall section body 45 of the respective outer wall sections 23 to 26 that is substantially adjacent from above to an upper face of the respective support member 52 is configured as a thickened portion 55 with a substantially triangular shaped vertical cross-section. The thickened portion 55 is installed across substantially the entire length of the each outer wall section 23 to 26 in substantially the horizontal direction (in other words, substantially the length direction) thereof. Thus, in order to prevent dirty water, dust, or the like from entering between the lower end 46 and the support member 52, and between the lower end 46 and the cover member 53, one side of the lower end faces of two side portions in the thickness direction of the thickened portion 55 abuts substantially the upper face of the support member 52, and another side of the lower end faces abuts substantially the upper face of the cover member 53.

The outer wall section 23 may, as illustrated in FIG. 1 and FIG. 2, etc., be formed in substantially the same shape as the leg side outer wall section 24, except for the outer wall section 23 having the cutout shaped indentation 31 and the grommet members 42. The left side outer wall section 25 may be formed in substantially the same shape as the right side outer wall section 26. In order to form escape sections for the four attachment members 54 at both ends of the respective support members 52 of the outer wall sections 23 to 26, cutouts 56 are respectively provided to portions corresponding to the attachment members 54. The substantially horizontal direction lengths of the respective support members 52 are thereby configured slightly shorter than the substantially horizontal direction lengths of the respective wall bodies 45 of the outer wall sections 23 to 26. Cutouts 57 are also provided connected to the respective cutouts 56 in the vicinity of the lower ends on the respective left and right sides, or front and rear sides, of the wall bodies 45 of the outer wall sections 23 to 26 when in the upstanding state. Moreover, as illustrated in FIG. 1 to FIG. 3, in the upstanding state, the respective outer wall sections 23 to 26 curve in an arc so as to protrude slightly from the inside toward the outside as viewed in a substantially plan view. When respectively viewing the outer wall sections 23 to 26 in the upstanding state from a substantially plan view, a length direction central portion of the respective outer wall sections 23 to 26 has a substantially circular arc shape of comparatively large diameter (in other words, a substantially circular arc shape having a comparatively small amount of curvature), and both length direction end portions of the respective outer wall sections 23 to 26 are each a substantially circular arc shape having a comparatively small diameter (in other words, a substantially circular arc shape having a comparatively large amount of curvature). The respective outer wall sections 23 to 26 are curved bodies having no substantially angular portions and continuing from one end portion from out of the two end portions, through the central portion, to the other end portion from out of the two end portions.

Figure 4:
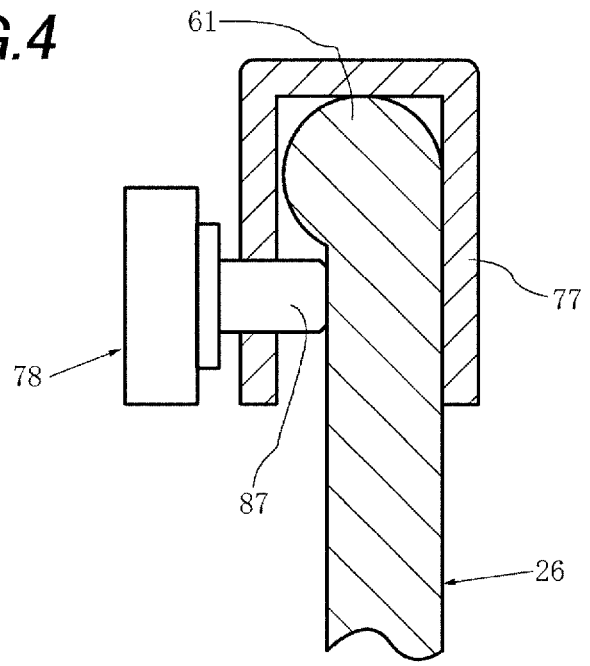
FIG. 4 is a partial vertical cross-section in the vicinity of an attachment-attaching tool illustrated in FIG. 1.
Figure 5:
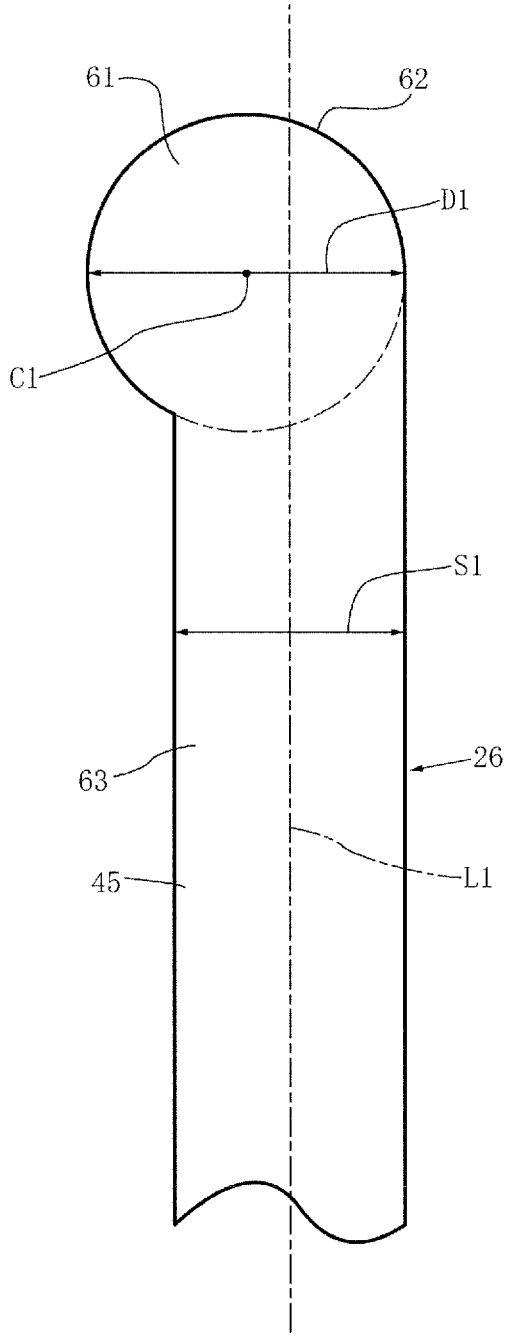
FIG. 5 is an enlarged vertical cross-section in the vicinity of a leading end of the right side outer wall section illustrated in FIG. 1, in a state with hatching omitted.

As illustrated in FIG. 3 to FIG. 5, a solid rod shaped (in other words, solid bar shaped or solid elongated shaped) protrusion 61, which may have a substantially circular shaped cross-section or the like in a direction substantially orthogonal to the length direction, is formed by integral molding or the like at an upper end of the wall section body 45 of the respective outer wall sections 24 to 26 in the upstanding state. Note that the protrusion 61 may be formed across substantially the entire length of the upper end of the wall section body 45. As illustrated in FIG. 3, etc. the protrusion 61 projects out in a substantially circular arc shape at both the upper side and outer side of the upper end of the wall section body 45 in the upstanding state. A center C1 of a circle configuring a substantially circular arc 62 of the protrusion 61 is offset by approximately 1.5 mm toward an outer face in the plate thickness direction of the wall section body 45 in the upstanding state. In other words, the center C1 is offset approximately 1.5 mm further toward the outer face than a center line L1 extending in the length direction and passing through the center in the plate thickness direction of the wall section body 45. Note that in the present exemplary embodiment, a diameter D1 of a circle configuring the circular arc 62 of the protrusion 61 is approximately 11 mm. From a practical perspective, the diameter D1 of the circle (in other words, the horizontal direction width of the protrusion 61) is generally preferably within a range from 7 mm to 15 mm, is more preferably within a range from 8 mm to 14 mm, and is most preferably within a range from 9 mm to 13 mm. In the present exemplary embodiment, a thickness S1 of an intermediate portion 63 of the wall section body 45 excluding the protrusion 61 (in other words, a portion between the protrusion 61 and the thickened portion 55) is approximately 8 mm. From a practical perspective, the thickness S1 is generally preferably within a range from 5.3 mm to 10.7 mm, is more preferably within a range from 6 mm to 10 mm, and is most preferably within a range from 6.4 mm to 9.6 mm. In the present exemplary embodiment, a ratio of the thickness S1 of the intermediate portion 63 with respect to the horizontal direction width D1 of the protrusion 61 (namely, S1/D1) is approximately 0.73. From a practical perspective, the ratio of the thickness S1 of the intermediate portion 63 with respect to the horizontal direction width D1 of the protrusion 61 (namely, S1/D1) is generally preferably within a range from 0.45 to 0.9, is more preferably within a range from 0.5 to 0.85, and is most preferably within a range from 0.55 to 0.8.

Figure 6:
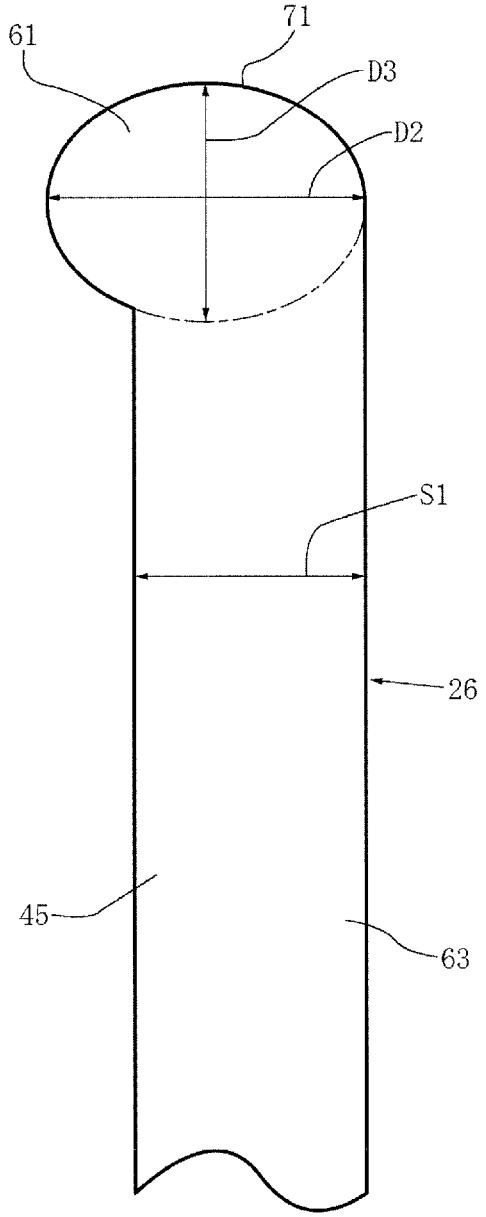
FIG. 6 is an enlarged vertical cross-section in the vicinity of a leading end of a modified example 1 of the right side outer wall section illustrated in FIG. 5, in a state with hatching omitted.
Figure 7:
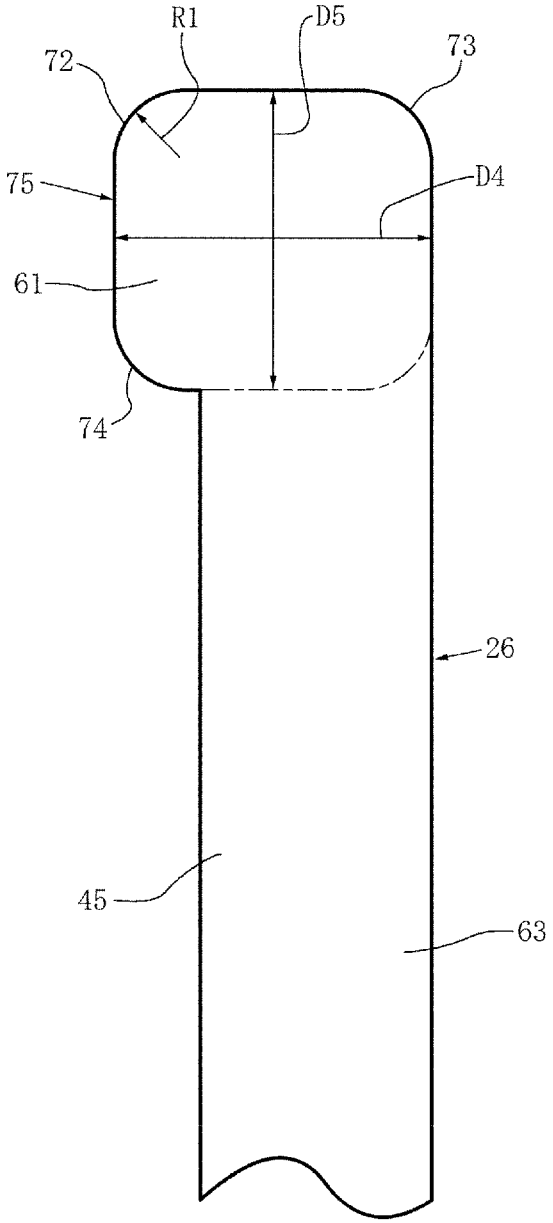
FIG. 7 is an enlarged vertical cross-section in the vicinity of a leading end of a modified example 2 of the right side outer wall section illustrated in FIG. 5, in a state with hatching omitted.

The cross-section shape of the rod shaped protrusion 61 of the wall section body 45 of the respective outer wall sections 24 to 26 in the upstanding state is not necessarily limited to the shape illustrated in FIG. 3 to FIG. 5, etc., and may be modified into various shapes, as respectively illustrated in FIG. 6 and FIG. 7, for example. Note that in the case of a modified example 1 illustrated in FIG. 6, the substantially circular arc 62 of the protrusion 61 of the exemplary embodiment illustrated in FIG. 5 has become an arc 71 of substantially elliptical shape (in other words, become a solid elliptical arc). A major axis D2 of the elliptical arc extends along substantially the horizontal direction in the upstanding state of the wall section body 45. A short axis D3 of the elliptical arc extends along substantially the vertical direction in the upstanding state of the wall section body 45. Note that the major axis D2 has substantially the same length as the diameter D1 illustrated in FIG. 5. Generally, from a practical perspective, the preferable range, the more preferable range, and the most preferable range of the diameter D1 illustrated in FIG. 5 are applied unchanged to the major axis D2. The short axis D3 is smaller than the diameter D1 illustrated in FIG. 5, and is approximately 8 mm. From a practical perspective, the short axis D3 is generally preferably within a range from 5.3 mm to 10.7 mm, is more preferably within a range from 6 mm to 10 mm, and is most preferably within a range from 6.4 mm to 9.6 mm. In the modified example 1, a ratio of the short axis D3 with respect to the major axis D2 (namely, D3/D2) is approximately 0.73. The ratio of the short axis D3 with respect to the major axis D2 is preferably within a range from 0.49 to 0.97, is more preferably within a range from 0.55 to 0.91, and is most preferably within a range from 0.58 to 0.88. In the modified example 1, the thickness S1 of the intermediate portion 63 of the wall section body 45, and a ratio of the thickness S1 of the intermediate portion 63 with respect to the horizontal direction width D2 of the protrusion 61 (namely, S1/D2) are both substantially the same values as those in the exemplary embodiment illustrated in FIG. 5. From a practical perspective, the preferable range, the more preferable range, and the most preferable range of the ratio S1/D1 illustrated in FIG. 5 are generally respectively applied unchanged to the ratio S1/D2. However, in the modified example 1, a ratio of the thickness S1 with respect to the short axis D3 (namely, S1/D3) is approximately 1.0. From a practical perspective, in the modified example 1, the ratio of the thickness S1 of the intermediate portion 63 with respect to the short axis D3 (namely, S1/D3) is generally preferably within a range from 0.67 to 1.33, is more preferably within a range from 0.75 to 1.25, and is most preferably within a range from 0.8 to 1.2.

In the case of a modified example 2 illustrated in FIG. 7, the substantially circular arc of the protrusion 61 of the exemplary embodiment illustrated in FIG. 5 may become an arc 75 of substantially square shape (in other words, including a rectangular shape) with respectively rounded corners 72 to 74 (in order words, become a solid square shaped arc). A height (in other words, a vertical direction length) D5 and a horizontal width (in other words, a horizontal direction width) D4 of the arc 75 are both substantially the same lengths as each other. A radius R1 of rounded portions configuring the respective corners 72 to 74 of the square is approximately 2.5 mm. From a practical perspective, the preferable range, the more preferable range, and the most preferable range of the diameter D1 illustrated in FIG. 5 are generally respectively applied unchanged to the respective value ranges relating to the height D5 and the width D4 of the square. From a practical perspective, the radius R1 of the respective corners 72 to 74 of the square is generally preferably within a range from 1.67 mm to 3.33 mm, is more preferably within a range from 1.88 mm to 3.13 mm, and is most preferably within a range from 2 mm to 3 mm.

A height difference H1 (see FIG. 2) in a substantially vertical direction between the upper end of the respective outer wall section 24 to 26 in the upstanding state and the upper end of the respective inner wall section 32 to 34 is approximately 84.5 mm in the illustrated exemplary embodiment. From a practical perspective, the height difference H1 is generally preferably within a range of from 56.3 mm to 112.7 m, is more preferably in a range of from 63.4 mm to 105.6 mm, and is most preferably in a range of from 67.6 mm to 101.4 mm.

4. Explanation of Operation of Outer Wall Section Structure

When respectively swinging out the leg side outer wall section 24 and the left and right side outer wall sections 25, 26 from the upstanding state illustrated in FIG. 1 to the hanging state as illustrated for the outer wall sections 24, 25 in FIG. 2, first, a user disengages locking of the respective outer wall sections 24 to 26 in a swung-back state by a lock device (not illustrated in the drawings). Next, the user can swing the respective outer wall sections 24 to 26 out from the upstanding state to the hanging state by swinging the outer wall sections 24 to 26 about the respective swing pivot points of the pairs of swing support shafts as required. Note that the out swing of the respective outer wall sections 24 to 26 can also be performed so as to be decelerated by a damping function of a damper (not illustrated in the drawings) capable of suppressing the swing speed of the out swing. Then, in order to swing the respective outer wall sections 24 to 26 in the hanging state back to the upstanding state, a user may manually swing back the respective outer wall sections 24 to 26 about the pivot points of the pairs of swing support shafts of the outer wall sections 24 to 26.

When a user lays an infant such as a newborn baby on the mattress 21 of the open incubator 11 illustrated in FIG. 1, etc., or picks up the infant from the mattress 21, the user places their arm in the infant accommodation space 27. There is a possibility that the arm of the user may contact an upper end of the outer wall sections 24 to 26 in such cases. Note that the upper ends of the respective outer wall sections 24 to 26 are each configured by the protrusion 61 with a substantially circular shaped cross-section or the like. Thus, even if the arm of the user makes comparatively hard contact with an upper end of the wall bodies 45 (an upper face or sloped face thereof in particular), there is no concern of the user feeling pain or injuring their arm. Moreover, the respective outer wall sections 24 to 26 curve in an arc so as to bulge out slightly from the inside toward the outside as viewed in a substantially plan view. This, combined with the fact that the wall bodies 45 include the protrusions 61, enables the respective outer wall sections 24 to 26 to have sufficient strength as outer peripheral wall sections of the infant accommodation space 27 of the open incubator 11. These two advantageous effects are not only exhibited in the case of the protrusion 61 illustrated in FIG. 5, but can also be exhibited to similar or greater effect in the cases of the protrusions 61 respectively illustrated in FIG. 6 and FIG. 7.

When a user or the like observes an infant or the like on the mattress 21 from the vicinity of the open incubator 11 illustrated in FIG. 1, the substantially transparent protrusions 61 respectively illustrated in FIG. 5 to FIG. 7 only slightly obstruct a comparatively narrow region of the field of vision of the user or the like. Thus, there is no concern that observation of the infant or the like on the mattress 21 by the user or the like might be greatly hindered by the presence of the protrusions 61. The protrusions 61 respectively illustrated in FIG. 6 and FIG. 7 are also similar or superior to the protrusion 61 illustrated in FIG. 5 with respect to appearance. The respective outer wall sections 23 to 26 curve in an arc so as to project out slightly from the inside toward the outside in the upstanding state as viewed in a substantially plan view. The degree of curvature in particular is larger at both length direction end portions than at the length direction central portion of the respective outer wall sections 23 to 26. This widens the infant accommodation space 27 to a certain extent, gives the open incubator 11 a good appearance, and also improves the strength of the outer wall sections 23 to 26. As illustrated in FIG. 1, in cases in which an attachment-attaching tool 76 is attached to the outer wall section 25, for example, from out of the outer wall sections 24 to 26 illustrated in FIG. 5 to FIG. 7, an attachment-attaching tool 76 generally employed hitherto may be employed as the attachment-attaching tool as illustrated in FIG. 4, since the width direction thickness of the protrusion 61 on the outer wall section 25 is not particularly large. There is accordingly no need for a user to prepare an attachment-attaching tool with a special shape or a special structure in order to attach an attachment to the open incubator 11 illustrated in FIG. 1. Note that the attachment-attaching tool 76 includes an attaching tool body 77 with a substantially U shaped vertical cross-section, and a locking screw 78 that is screwed into the attaching tool body 77 so as to be capable of being both screwed in and screwed out thereof.

Figure 8:
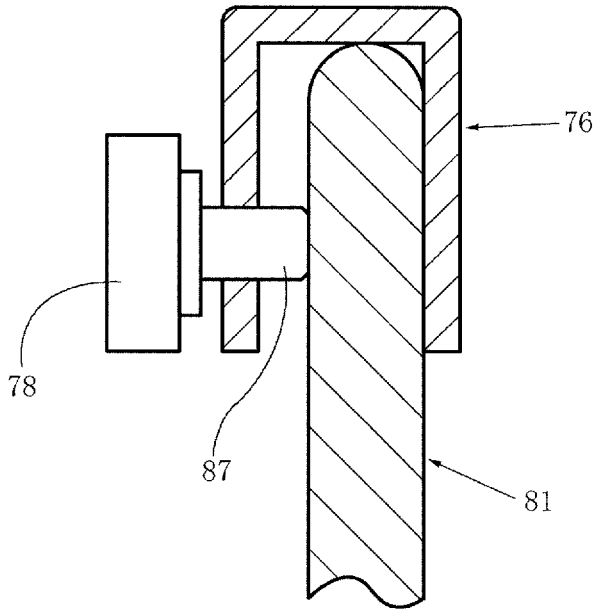
FIG. 8 is a partial vertical cross-section in the vicinity of an attachment-attaching tool, in a state in which the attachment-attaching tool illustrated in FIG. 4 is employed in the open incubator of Patent Document 1.
Figure 9:
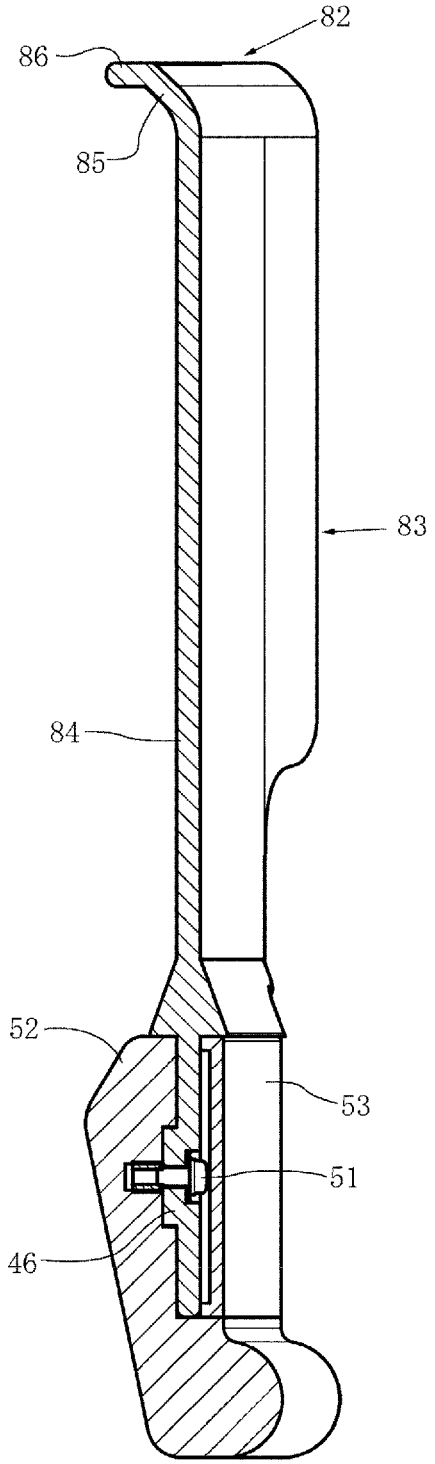
FIG. 9 is a similar vertical cross-section to FIG. 3, illustrating an outer wall section of a reference example 2 of the present invention.
Figure 10:
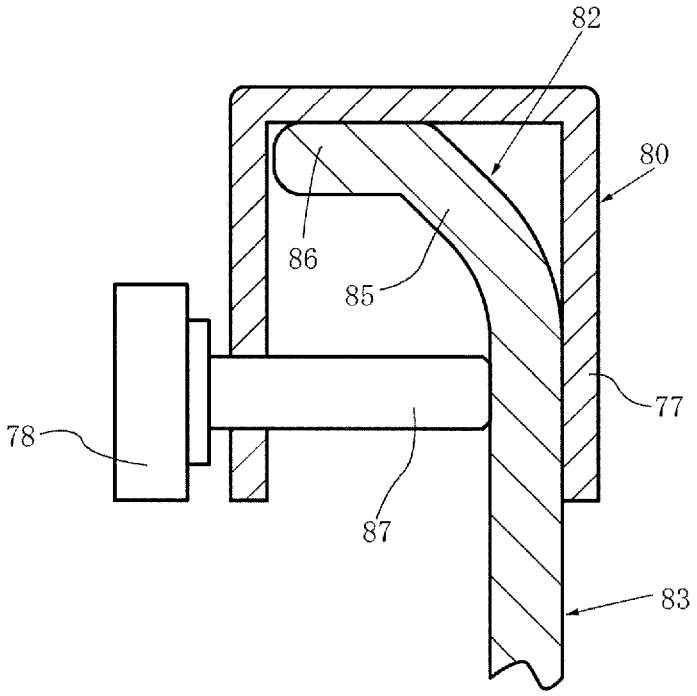
FIG. 10 is a partial vertical cross-section in the vicinity of an attachment-attaching tool, in a state in which an attachment-attaching tool with a different structure from the attachment-attaching tool illustrated in FIG. 8 is employed on the outer wall section illustrated in FIG. 9.

FIG. 8 illustrates a reference example 1 in a state in which the attachment-attaching tool 76 illustrated in FIG. 4 is attached to a movable wall section 81 of the Patent Document 1. FIG. 9 illustrates a movable wall section 83 as a reference example 2 that is substantially similar to that illustrated in FIG. 3, except in the respect that the shape of a protrusion 82 is different to that of the outer wall section 26 illustrated in FIG. 3. In the reference example 2, the protrusion 82 respectively includes an inclined portion 85 and a horizontal portion 86 that are generally sequentially continuous to an upper face of a wall section body 84. In FIG. 10, the reference example 2 is illustrated a state in which a different attachment-attaching tool 80 is attached in the vicinity of the protrusion 82 of the movable wall section 83 illustrated in FIG. 9. The different attachment-attaching tool 80 illustrated in FIG. 10 has an attaching tool body 77 with a wider width, and a shaft 87 of the locking screw 78 with a longer length, than those of the attachment-attaching tool 76 illustrated in FIG. 4 and FIG. 8. Note that in FIG. 9, portions that are substantially the same as those in FIG. 3 are appended with the same reference numerals as those in FIG. 3, except for those portions that have already been appended with reference numerals.

An exemplary embodiment and modified examples 1 and 2 of the present invention have been explained in detailed above. However, the present invention is not limited to the exemplary embodiment and modified examples, and various modifications and revisions are possible based on the spirit of the invention as recited in the scope of the claims.

For example, in the above-described exemplary embodiment and modified examples, the present invention is applied to an open incubator. However, the present invention may be applied to not only an open incubator, but also to an open incubator that may be employed as a closed incubator. In such cases, a substantially box-lid shaped upper hood that is capable of moving substantially upward and downward may be provided to enable the infant accommodation space 27 to be selectably covered from above. Such an upper hood may be configured with an upper face section that may be substantially transparent, and with upper side walls that may be substantially transparent, are substantially rectangular shaped when viewed in plan view, and project substantially downward from the vicinity of the outer periphery of the upper face section. Configuration may also be made such that the incubator becomes an open incubator by opening the upper face of the infant accommodation space 27 when the upper hood is raised, and becomes a closed incubator by closing the top upper of the infant accommodation space 27 when the upper hood is lowered.

In the above-described exemplary embodiment and modified examples, each rod shaped protrusion 61 is configured in a substantially circular shape, a substantially elliptical shape, or a substantially square shape with rounded corners in cross-section in a direction substantially orthogonal to the length direction thereof. However, the cross-section of the rod shaped protrusion 61 may be configured in a substantially oval shape. The cross-section of the rod shaped protrusion 61 may also be configured in a polygonal shape with rounded corners, such as a substantially regular polygonal shape that is a substantially octagonal shape, an inverted substantially heptagonal shape, a substantially hexagonal shape, an inverted substantially pentagonal shape, or an inverted substantially triangular shape. The cross-section of the rod shaped protrusion 61 may also be a shape configured of a combination of half and so on of two or more of the plural shapes out of the various shapes described above, such as a substantially circular shape and a substantially hexagonal shape with rounded corners.

In the above-described exemplary embodiment and modified examples, each rod shaped protrusion 61 projects out at the upper side and outside of the upper end of the respective wall section body 45 in the upstanding state. However, the protrusion 61 may also project out at the inside of the upper end. The protrusion 61 may also be configured so as to only project out at the upper side and inside of the upper end.

In the above-described exemplary embodiment and modified examples, each rod shaped protrusion 61 is formed in a solid rod shape. However, the rod shaped protrusion 61 does not necessarily have to be formed in a solid rod shape, and may be formed in a hollow rod shape.

In the above-described exemplary embodiment and modified examples, each rod shaped protrusion 61 is formed by integral molding or the like to the upper end of the respective wall section body in the upstanding state. However, a rod shaped protrusion may be joined to the upper end by adhesive, insertion, or the like after having been molded as a separate body.

In the above-described exemplary embodiment and modified examples, all the raised corners out of the raised corners 72 to 74 of each rod shaped protrusion 61 are rounded. However, the modified example 2 illustrated in FIG. 7, for example, may be configured such that the raised corners 72, 73 formed on the upper face of the protrusion 61 are rounded, and the raised corner 74 formed on the lower face of the protrusion 61 is not particularly rounded.

What is claimed is:

1. An incubator comprising:

an incubator base; and a plurality of outer wall members standing up from the incubator base to collectively define an infant accommodation space surrounded by the plurality of outer wall members, at least one of the plurality of outer wall members comprising a generally rectangular wall plate extending upright, the wall plate having an inner surface facing an inner side of the incubator and an outer surface facing an outer side, opposite to the inner side in a thickness direction of wall plate, of the incubator, the wall plate further having a upper edge extending in a width direction of the wall plate to define an upper bound of the wall plate, wherein the wall plate comprises an elongated bulge extending in the width direction of the wall plate to define at least part of the upper edge of the wall plate and having an exterior devoid of any projecting angular point or ridge and an interior devoid of any void space, the elongated bulge protruding in the thickness direction from the outer surface of the wall plate toward the outer side of the incubator so that the elongated bulge has a maximum thickness measured in the thickness direction greater than a thickness of an intermediate section, measured in the thickness direction, of the wall plate exclusive of the elongated bulge.

2. The incubator of claim 1, wherein the exterior of the elongated bulge is formed all with a curved surface.

3. The incubator of claim 1, wherein:

a ratio of the thickness of the intermediate section of the wall plate exclusive of the elongated bulge with respect to the maximum thickness of the elongated bulge is within a range from 0.45 to 0.9; and a ratio of the thickness of the intermediate section of the wall plate with respect to a height of the elongated bulge is within a range from 0.45 to 0.9.

4. The incubator of claim 1, wherein:

a ratio of the thickness of the intermediate section of the wall plate exclusive of the elongated bulge with respect to the maximum thickness of the elongated bulge is within a range from 0.5 to 0.85; and a ratio of the thickness of the intermediate section of the wall plate with respect to a height of the elongated bulge is within a range from 0.5 to 0.85.

5. The incubator of claim 1, wherein:

a ratio of the thickness of the intermediate section of the wall plate exclusive of the elongated bulge with respect to the maximum thickness of the elongated bulge is within a range from 0.55 to 0.8; and a ratio of the thickness of the intermediate section of the wall plate with respect to a height of the elongated bulge is within a range from 0.55 to 0.8.

6. The incubator of claim 1, wherein the exterior of the elongated bulge is shaped with a part of a circle in vertical cross-section.

7. The incubator of claim 1, wherein the exterior of the elongated bulge is shaped with straight lines in vertical cross-section.

8. The incubator of claim 1, wherein:

a ratio of the thickness of the intermediate section of the wall plate exclusive of the elongated bulge with respect to the maximum thickness of the elongated bulge is within a range from 0.45 to 0.9; and a ratio of the thickness of the intermediate section of the wall plate with respect to a height of the elongated bulge is within a range from 0.67 to 1.33.

9. The incubator of claim 1, wherein:

a ratio of the thickness of the intermediate section of the wall plate exclusive of the elongated bulge with respect to the maximum thickness of the elongated bulge is within a range from 0.5 to 0.85; and a ratio of the thickness of the intermediate section of the wall plate with respect to a height of the elongated bulge is within a range from 0.75 to 1.25.

10. The incubator of claim 1, wherein:

a ratio of the thickness of the intermediate section exclusive of the elongated bulge with respect to the maximum thickness of the elongated bulge is within a range from 0.55 to 0.8; and a ratio of the thickness of the intermediate section of the wall plate with respect to a height of the elongated bulge is within a range from 0.8 to 1.2.

11. The incubator of claim 1, wherein the exterior of the elongated bulge is shaped with a part of an ellipse in vertical cross-section with a major axis of the ellipse being substantially in alignment with the thickness direction.

12. The incubator of claim 1, wherein the exterior of the elongated bulge is shaped with a part of an oval in vertical cross-section with the oval elongated substantially in the thickness direction.

* * * * *